United States Patent [19]

Smolanovich

[11] Patent Number: 4,750,741

[45] Date of Patent: Jun. 14, 1988

[54] BACK STRETCHING CHAIR

[76] Inventor: Peter Smolanovich, 9742 Eastwood Cir., Villa Park, Calif. 92667

[21] Appl. No.: 753,129

[22] Filed: Jul. 9, 1985

[51] Int. Cl.[4] ..... A63B 23/00; A47C 1/02; A61H 1/02

[52] U.S. Cl. ..... 272/144; 128/75; 297/343

[58] Field of Search ..... 128/70, 71, 74, 75, 128/78; 297/318, 317; 272/144, 145, 93, 72

[56] References Cited

U.S. PATENT DOCUMENTS 3,986,499 10/1976 Fisher ..... 128/71
4,282,868 11/1981 Riggs ..... 128/71 X
4,452,486 6/1984 Zapf et al. ..... 297/317 X

FOREIGN PATENT DOCUMENTS 1940391 2/1971 Fed. Rep. of Germany ..... 128/70

*Primary Examiner*—Richard J. Apley
*Assistant Examiner*—S. R. Crow

[57] ABSTRACT

A back stretching chair is presented. It comprises a generally rectangular base having fore and aft ends. A back rest member has top and bottom ends and is rotatably coupled by its bottom end to the aft end of the base by rotating hinge means so that the back rest can rotate about the aft end of the base. A moving seat is coupled above and parallel to the base and is capable of moving fore and aft in relation to the base. Coupling means couple the back rest to the moving seat so that when the back rest is moved down, the seat moves forward and when the back rest is moved up, the seat moves back. Moving the seat forward stretches the back.

9 Claims, 2 Drawing Sheets

BACK STRETCHING CHAIR

BACKGROUND OF THE INVENTION

1. Field of the Invention

The present invention relates to back stretching chairs.

2. Description of the Prior Art

Lower back pain either affects or is likely in the future to affect nearly everyone. One of the ways of relieving this pain is to slightly stretch the back. As a result, the prior art discloses a wide variety of traction devices. Some people, in order to stretch their back, even hang by the feet so that their head and upper body will pull down on the lower back, thereby stretching it.

While the prior art discloses a tremendous variety of back stretching and related traction devices, it does not really disclose anything which is inexpensive, simple to use, capable of getting the person with the bad back nearly total control, unlikely to injure, easy to store, and relatively attractive to look at. Such a device is needed, and applicant believes that the present invention has all of the preceeding advantages, as well a a basic simplicity and precision of control and quickness of response which make it eminently helpful in solving this problem of sore lower backs which alledgedly has been caused because our spine is more perfectly designed for a crawling animal than a biped walking erect on two feet.

SUMMARY OF THE INVENTION

A back stretching chair is presented. The chair comprises in a first example a generally rectangular base disposed generally along a plane and having fore and aft ends. The chair also includes a back rest member having top and bottom ends. The bottom end is rotatable coupled to the aft end of the base by rotating hinge means so that the back rest can rotate about the after end of the base in a selected arc of substantially less than 90°.

A moving seat is coupled slightly above the base and capable of moving fore and aft in relation to the base generally parallel to the base.

Rotation to linear force transfer coupling means couple the back rest member to the moving seat to convert rotational motion of the back rest member to a linear force. The linear force drives the moving seat forward in relation to the base when the back rest member is rotated toward the plane parallel to the base. The linear force drives the moving seat aft in relation to the base when the back rest is rotated away from the plane parallel to the base.

The seat moving means may comprise roller means which roll fore and aft along a ridge defined by the top surface of the two sides of the generally rectangular base. This arrangement permits the moving seat to roll fore and aft along the top surface of the two sides of the base on the roller means in response to linear force from the rotation to linear force transfer coupling means.

Alternatively, the seat moving means may comprise slide means which slide fore and aft along a ridge defined by the top surface of the two sides of the generally rectangular base. The slide means thereby permit the moving seat to slide fore and aft along the top surface of the two sides of the base on the slide means in response to linear force from the rotation to linear motion converting coupling means. The slide means are coupled to the bottom sides of the seat between the fore and aft ends of the seat. The aft end of the base may be elevated in relation to the fore end of the base by base aft end elevating means, thereby causing gravity to exert a force on the moving seat tending to cause the moving seat to move toward the fore end of the base and the aft end of the moving seat normally extends aft of the aft end of the base.

In one example the rotation to linear force transfer coupling means comprises a hinge coupled by a right rod to a point near the top of the right side of the back rest and the hinge is coupled by a left rod to a point near the top of the left side of the back rest. The hinge is coupled to the aft end of the moving seat by at least one rod substantially parallel to the moving seat. If there is only one rod parallel to the moving seat, the hinge is midway between the sides and the right rod and left rod form a V from the right and left sides of the back rest to the hinge.

In another example the rotation to linear force transfer coupling means comprises at least one convex rod coupled from near the top of the back of the back rest member to rod coupling means which in turn are coupled by at least one convex rod to the aft end of the moving seat. The curvatures of the rods are such that the rod coupling means are closer to the nearest surface of the back rest member because of the concave curving on the side closest to the back rest member of the acjacent parts of the rods. The combination of convex rods and rod coupling means are slightly flexible to compensate for rotation of the back rest means and moving fore and aft of the moving seat.

Accordingly, in operation, when the person sitting on the seat wants his back stretched he leans back which causes his legs and hips which rest on the moving seat to slide forward. A strap around the back may be used to keep the person's back stable so that it can be stretched, but in practice such a strap is not really required.

The chair is bilaterally symmetric about a longitudinal axis in that the left and right sides are mirror images of each other. The moving seat moves fore and aft on seat moving means capable of moving fore and aft along the top surface of the two sides of the base.

DRAWING DESCRIPTION

Reference should be made at this time to the following detailed description which should be read in conjunction with the following drawings, of which:

DETAILED DESCRIPTION

Figure 1:
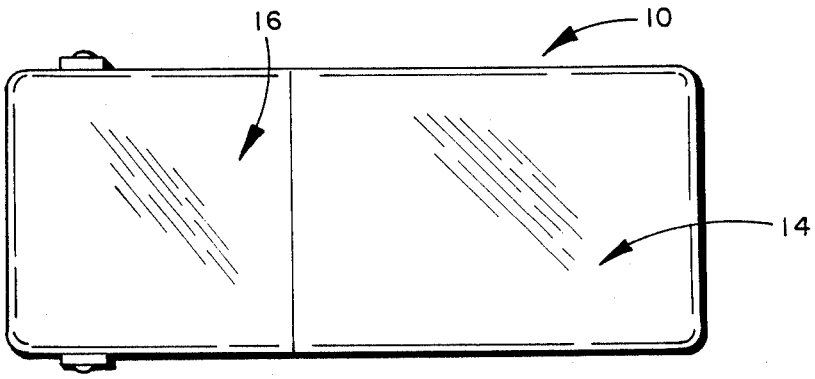
FIG. 1 illustrates a top view of a back stretching chair according to the present invention.
Figure 6:
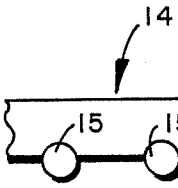
FIG. 6 illustrates a side view of a wheeled moving seat such as is illustrated in FIG. 4.

Reference should be made at this time to FIGS. 1–6 which illustrate various views of three different examples of a back stretching chair 10 according to the present invention. The chair 10 comprises a generally rectangular base 12 disposed generally along a plane and having fore and aft ends. A back rest member 16 having top and bottom ends transmits power from the user. The bottom end of the backa rest member 16 is rotatably coupled by a hinge 28 such as those known to the prior art to the aft end of the base. The hinge 28 comprises a rotating hinge means of any of the types known to the prior art so that the back rest 16 can rotate about the aft end of the base 12 in a selected arc of substantially less than 90° at a selected angle which in most applications is about 45° or somewhat less than 45° from the base 12.

A moving seat 14 is slideably supported on and coupled to the base 12 and is capable of moving fore and aft in relation to base 12 generally parallel to base 12. The seat 14 may be fabricated from practically any of the prior art materials used for seats with the restriction that when a person sits on the seat 14, he must not sink so far into the seat 14 so as to cause friction between the seat 14 and the base 12 which would interfer with operation of the chair 10.

Rotation to linear force transfer coupling means comprising a joint 22 couple the back rest member 16 to the moving seat 14 to convert rotational motion of the back rest member 16 to a linear force. The linear force drives the moving seat 14 forward in relation to the base 12 when the back rest member 16 is rotated toward the plane parallel to the base 12 when the back rest member 16 is lowered by pushing against it with the operator's back or with any other force. A force pushing the back rest 16 up drives the seat 14 aft in relation to the base 12 as the back rest member 16 is raised. Neither the operator nor a strap which the operator may use are shown. The operator would be anyone who sat down on the chair 10. If desired, the operator could wrap a strap around the back rest member 16 and around his body underneath his arms so that his back would be coupled more securely to the back rest member 16, but such a strap is not necessary.

In practice, after the back of the previous user has been stretched, the person gets up and lifts the back rest member 16. Then, when he wants to stretch his back again, he sits in the chair 10, leaning against the back rest member 16, and leaning back forcing the back rest 16 to rotate downward. The back rest member 16 has been raised prior to the operator sitting down. Lowering the back rest member 16 causes the legs and hips of the person sitting to move forward while the back basically stays in the same place, thereby stretching the back slightly. Even a one inch stretch is sufficient for most purposes, so the moving seat 14 does not normally move very far in relation to the base 12.

Figure 2:
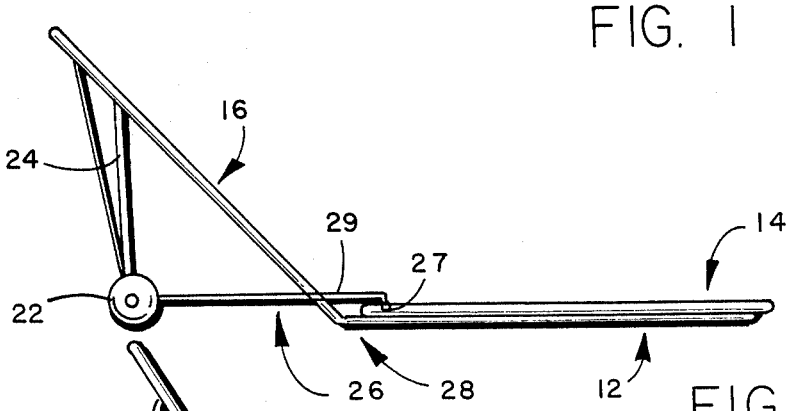
FIG. 2 illustrates a side view of a back stretching chair according to the invention.
Figure 3:
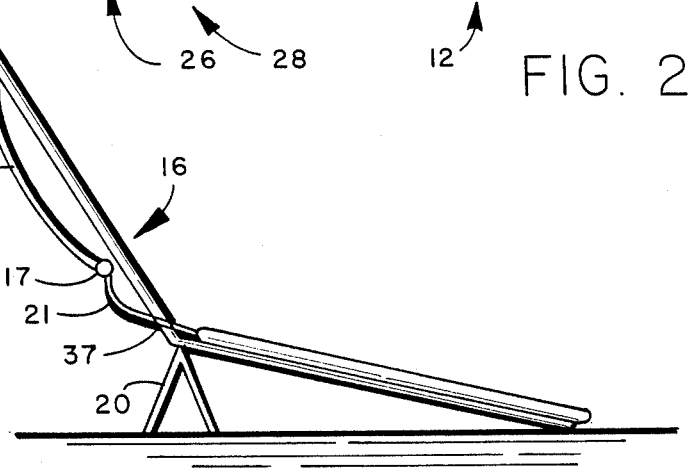
FIG. 3 illustrates a side view of a different example of a back stretching chair according to the present invention.
Figure 4:
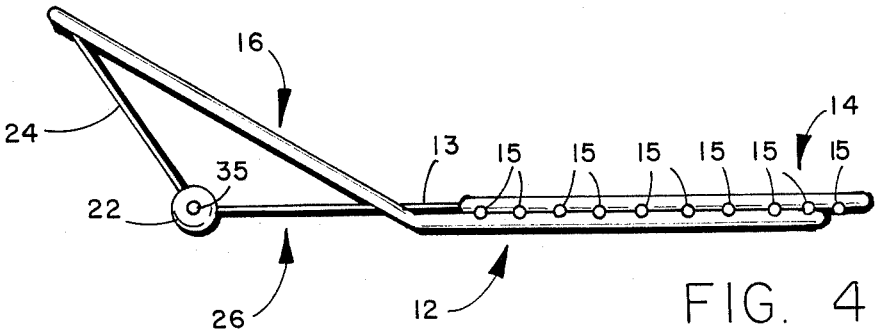
FIG. 4 illustrates a side view of yet a third example of a back stretching chair according to the present invention.
Figure 2A:
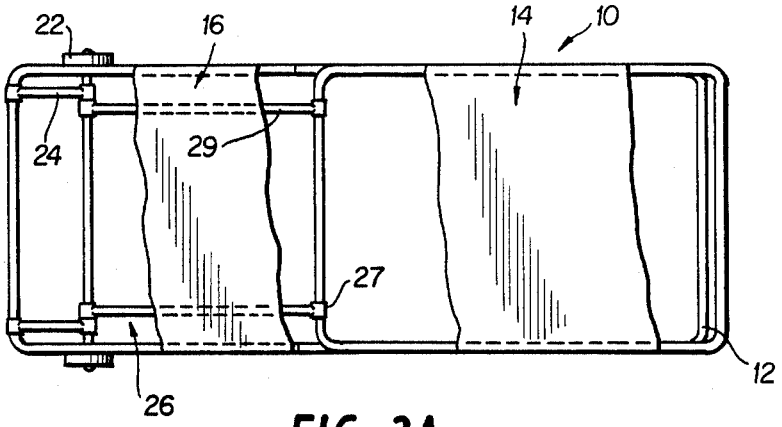
FIG. 2A illustrates a top view of the backstretching chair shown in FIG. 2.
Figure 4A:
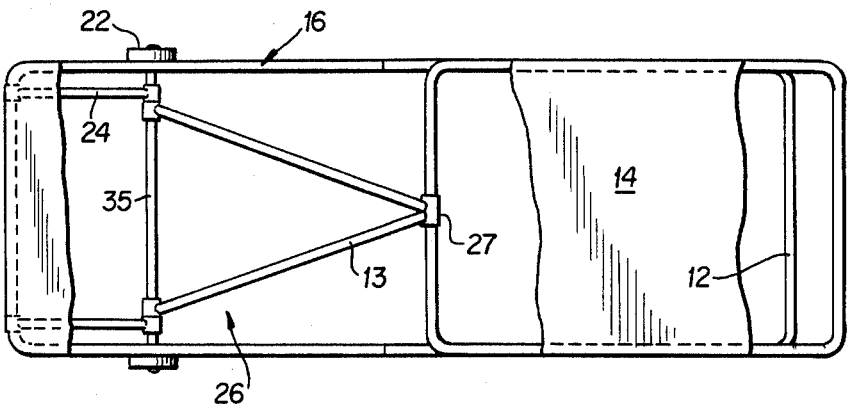
FIG. 4A illustrates a top view of the backstretching chair shown in FIG. 4.

FIGS. 2, 3, and 4 illustrate various examples of the chair 10. In FIG. 2, the rotation to linear force transfer coupling means comprises a joint 22 which rotates. Bars 24 coupled near the top of the back rest member 16 are coupled to the hinge 22. At least one other bar 26 is coupled to the seat 14 by coupling means 27. When the back rest member 16 is depressed or moved to a position more parallel to the base 12, the bars 24 depress joint 22 and rotate slightly forcing joint 22 to push the rod 29 which in turn pushes the sliding seat 14 forward.

Joint 22 may comprise a joint, ball joint or similar prior art hinge means or even a roller.

FIG. 3 illustrates two slight differences from FIGS. 2 and 4. FIG. 3 illustrates an elevated aft end of the base which is elevated on elevating means 20 so that the person can more easily slide because the person is sliding somewhat downhill. In addition, a curved rod 18 couples the top of the back rest member 16 to a relatively inflexible joint which is rod coupling means 17 and a curved rod 21 couples rod coupling means 17 to the aft end of the seat 14. Just a slight amount of flexibility in the rod coupling means 17 would be sufficient and the cost of manufacture would be somewhat reduced.

Figure 5:
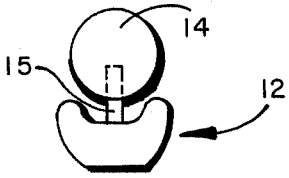
FIG. 5 illustrates an end view of a moving seat which slides along the top of the base of a back stretching chair such as is illustrated in FIGS. 2 and 3.

FIG. 5 illustrates an end view of one example of sliding means 15' coupled between the base 12 and the seat 14. The seat 14 could comprise a generally cylindrical rod as shown in FIG. 5 shaped into the generally rectangular shape shown in FIG. 1 and disposed above a generally U-shaped cross-section framework which comprised the base 12 as shown in FIG. 5. Teflon or a similar material could comprise the sliding means 15' disposed between the seat 14 and the base 12. While the circular rod 14 comprising the seat 14 would need to have some material there between such as canvas, plastic, or some form of sheet material capable of acting as a seat and tight enough so that the sitting of a person therein would not prevent sliding forward, the frame of the base 12 could be empty in the center and there is no real purpose in having any center to the base 12.

FIG. 4 illustrates a model similar to that of FIG. 2 except that rather than having the teflon 15 slide, ball bearings or rollers or very tiny wheels could comprise the means 15 used to reduce friction between the seat 14 and the base 12 during movement. The rod 26 could couple either to the top of the back of the seat 14 as shown in FIG. 2 or to the back or aft end of the seat 14 directly as shown in FIG. 4 or in any means known to the prior art.

The joint 22 can comprise at least one wheel, and preferably a pair of wheels 22, one beneath each of the sides of the backrest 16, each wheel capable of rolling on a flat surface or bed in a fore and aft direction in relation to the base 12 when the back rest member 16 rotates about the aft end of the base.

In another example, at least one convex rod 18 can be coupled from near the top of the back of the back rest member 16 to rod coupling means 17 which may be a hinge of a type known to the prior art. The rod coupling means 17 in turn may be coupled to at least one convex rod 21 as shown in FIG. 3 to the aft end of the moving seat 14 such that the rod coupling means 17 are closer to the nearest surface of the back rest member 16 because of the curving toward the back rest member 16 of the adjacent parts of the convex rods 18, 21. In this example the combination of the convex rods 18, 21 and rod coupling means 17 are only slightly flexible to compensate for rotation of the back rest means 16 and moving fore and aft of the moving seat 14.

A variety of possible coupling means between the top of the back rest member 16 and the seat 14 may be used. FIG. 2 shows a single wheel 22 coupled in a V arrangement to the back rest 16 with a single rod 29 coupled to the seat 14 by coupling means 27. A similar V type arrangement could be used with two rods 18 coupling to hinge means 17 coupling to one rod 21 in the arrangement shown in FIG. 3. Alternatively, the back rest 16 could couple to one coupling means 24 or 18 which in turn is coupled to either the side or center of the aft end of the sliding seat 14. Alternatively, the back rest 16 could couple to each side to a different one of a pair of coupling means 24 or 18 which in turn each couple to a different rod coupling means 17 or joint 22 which in turn couple to each side of the aft end of the seat 14. An arrangement similar to this using joints 22 is illustrated in FIG. 1.

With a V-shaped arrangement (FIG. 2), there would be one rod coupling means 17 (FIG. 3) or joint 22 midway between the sides and the V-shape would be formed by a right rod 18 or 24 and a left rod 18 or 24 from the right and left sides of the back rest 16 to the hinge 17. With the arrangement shown in FIG. 1, the hinge would be coupled by a right rod 24 or 18 to a point near the top of the right side of the back rest 16 and the hinge 22 or 17 would be coupled by a left rod 24 or 18 to a point near the top of the left side of the back rest 16 and the hinge would then be coupled to the aft end of the seat 14 by additional coupling means 29 or 21.

The aft end 37 of the base 12 can be elevated in relation to the fore end of the base by base aft end elevating means 20 as shown in FIG. 3. This arrangement causes gravity to exert a force on the moving seat 14 tending to cause the moving seat 14 to move toward the fore end of the base 12.

An arrangement using a joint 22 or a rod coupling means 17 may be used by placing it on a bed, but the joint 22 and the arrangement shown in FIG. 2 would probably work best with wheels 15 rolling the seat 14 along the base 12. The term rod coupling means, as used herein, includes any of the prior art means of coupling rods such as hinges, joints, etc. The term joint 22 includes any of the prior art types of joints such as joints, hinges, and other coupling means. The term bar 24 includes any of the prior art equivalents of a bar such as rods.

Any of the prior art material used for chairs, particularly folding chairs and portable chairs may be used for the present invention so long as they do not substantially increase weight or friction and are sturdy. In like manner, the wheels 15 or other means used to reduce friction between the sliding seat 14 and the adjacent surface of the base 12 in contact with the means coupling the seat 14 to the base 12 may be any of the means known to the prior art to reduce friction under similar circumstances. It is believed that a generally U-shaped cross-section for the sides of the base 12 as shown in FIG. 5 would provide substantial advantages in that the seat 14 would be less likely to slide off the base 12 by moving to the side. A belt (not shown) could be used to couple the user (not shown) to the seat 14.

A particular example of the invention has been disclosed herein. Other examples will be obvious to those skilled in the prior art. The invention is limited only by the following claims:

I claim:

1. A backstretching chair bilaterally symmetric about a longitudinal axis, comprising:

A generally rectangular base disposed generally along a plane and having fore and aft ends coupled together by two sides;

a back rest member having top and bottom ends, the bottom end rotatably coupled to the aft end of the base by rotating hinge means so that the back rest can rotate about the aft end of the base in a selected arc between substantially greater than 90° and a generally parallel position with respect to the base; a moving seat slidingly supported on the base and capable of moving fore and aft in relation to the base generally parallel to the base on seat moving means capable of moving fore and aft along the top surface of the two sides of the base;

rotation to linear force transfer coupling means coupling the back rest member to the moving seat to convert rotational motion of the back rest member to a linear force driving the moving seat forward in relation to the base when the back rest member is rotated toward the plane parallel to the base and driving the moving seat aft in relation to the base when the back rest is rotated away from the plane parallel to the base whereby a person sitting on the seat and leaning against the backrest member moves the seat forward thereby stretching the back.

2. The invention of claim 1 wherein the seat moving means comprise roller means which roll fore and aft along a ridge defined by the top surface of the two sides of the generally rectangular base, thereby permitting the moving seat to roll fore and aft along the top surface of the two sides of the base on the roller means in response to linear force from the rotation to linear force transfer coupling means.

3. The invention of claim 1 wherein:

The seat moving means comprise slide means which slide fore and aft along a ridge defined by the top surface of the two sides of the generally rectangular base, thereby permitting the moving seat to slide fore and aft along the top surface of the two sides of the base on the slide means in response to linear force from the rotation to linear force transfer coupling means and wherein said slide means are coupled to the bottom sides of the seat between the fore and aft ends of the seat.

4. The invention of claim 3 wherein the aft end of the base is elevated in relation to the fore end of the base by base aft end elevating means, thereby causing gravity to exert a force on the moving seat tending to cause the moving seat to move toward the fore end of the base and the aft end of the moving seat is capable of moving aft of the aft end of the base.

5. The invention of claim 1 wherein the rotation to linear force transfer coupling means comprises hinge means comprising at least one hinge coupled by a right rod to a point near the top of the right side of the back rest and the hinge is coupled by a left rod to a point near the top of the left side of the back rest and the hinge is coupled to the aft end of the moving seat by at least one rod substantially parallel to the moving seat.

6. The invention of claim 5 wherein there is only one rod parallel to the moving seat, one hinge is midway between the sides and the right rod and left rod form a V-shape from the right and left sides of the back rest to the hinge.

7. The invention of claim 5 wherein the hinge means comprises at least one wheel capable of rolling in a fore and aft direction in relation to the base when the back rest member rotates about the aft end of the base.

8. The invention of claim 1 wherein at least one convex rod is coupled from near the top of the back of the back rest member to rod coupling means which in turn are coupled by at least one convex rod to the aft end of the moving seat such that the rod coupling means are held closer to the nearest surface of the back rest member by the convex rods and wherein the combination of convex rods and rod coupling means are only slightly flexible to compensate for rotation of the back rest means and moving fore and aft of the moving seat.

9. The invention of claim 1 wherein the sides of the base along which the means coupling the seat to the base move have a generally U shaped cross section to prevent the seat from sliding off the base by the seat moving to the side.

* * * * *